US005878727A

United States Patent [19]

Huls

[11] Patent Number: 5,878,727

[45] Date of Patent: Mar. 9, 1999

[54] METHOD AND SYSTEM FOR ESTIMATING FUEL VAPOR PRESSURE

[75] Inventor: Thomas Allan Huls, Allen Park, Mich.

[73] Assignee: Ford Global Technologies, Inc., Dearborn, Mich.

[21] Appl. No.: 867,313

[22] Filed: Jun. 2, 1997

[51] Int. Cl.[6] ..... F02M 33/04

[52] U.S. Cl. ..... 123/520

[58] Field of Search ..... 123/516, 518, 123/519, 520, 198 D; 73/117.3, 118.1, 119 A

[56] References Cited

U.S. PATENT DOCUMENTS

| | | | |
|---|---|---|---|
| 5,237,979 | 8/1993 | Hyodo et al. | 123/520 |
| 5,259,353 | 11/1993 | Nakai et al. | 123/520 |
| 5,261,379 | 11/1993 | Lipinski et al. | 123/520 |
| 5,275,144 | 1/1994 | Gross | 123/518 |
| 5,313,925 | 5/1994 | Otsuka et al. | 123/520 |
| 5,333,590 | 8/1994 | Thomson | 123/520 |
| 5,379,638 | 1/1995 | Denz et al. | 73/291 |
| 5,400,759 | 3/1995 | Ishida | 123/520 |
| 5,408,866 | 4/1995 | Kawamura et al. | 123/518 |
| 5,419,182 | 5/1995 | Koshimizu et al. | 73/46 |
| 5,443,051 | 8/1995 | Otsuka | 123/520 |
| 5,445,015 | 8/1995 | Namiki et al. | 73/118.1 |
| 5,542,397 | 8/1996 | Takahata et al. | 123/520 |
| 5,614,665 | 3/1997 | Curran et al. | 73/118.1 |

*Primary Examiner*—Thomas N. Moulis
*Attorney, Agent, or Firm*—James J. Dottavio; Roger L. May

[57] ABSTRACT

A method for estimating fuel vapor pressure includes determining (102) an amount of fuel present in a fuel tank, pumping (104) a vapor mixture from the fuel tank until a predetermined gauge pressure is obtained, and measuring (108) the time necessary to reach the predetermined gauge pressure. Fuel vapor pressure is than directly quantified (108) based on the measured time and the detected fill level. Thus, an estimate of the fuel vapor pressure can be obtained without requiring information regarding fuel temperature, or addition of any dedicated sensor circuitry to a conventional on-board vapor management/leak detection system.

16 Claims, 3 Drawing Sheets

Fig. 2
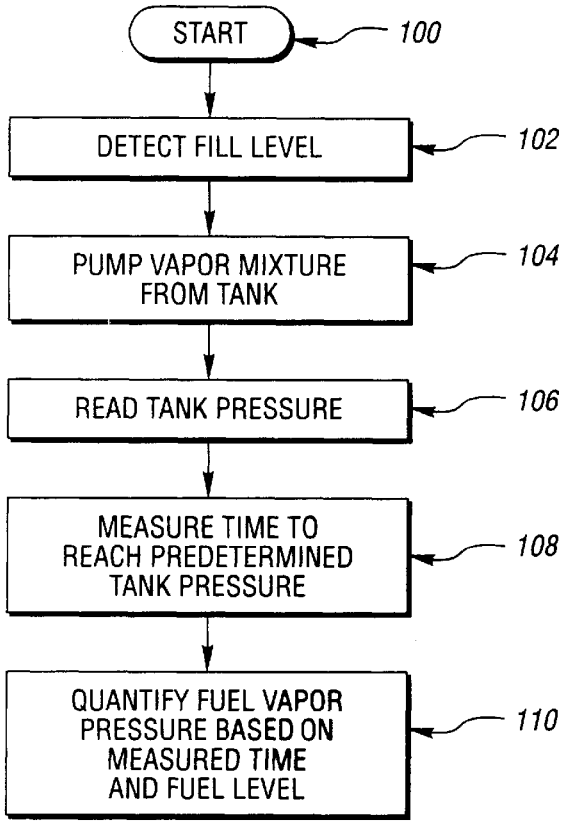
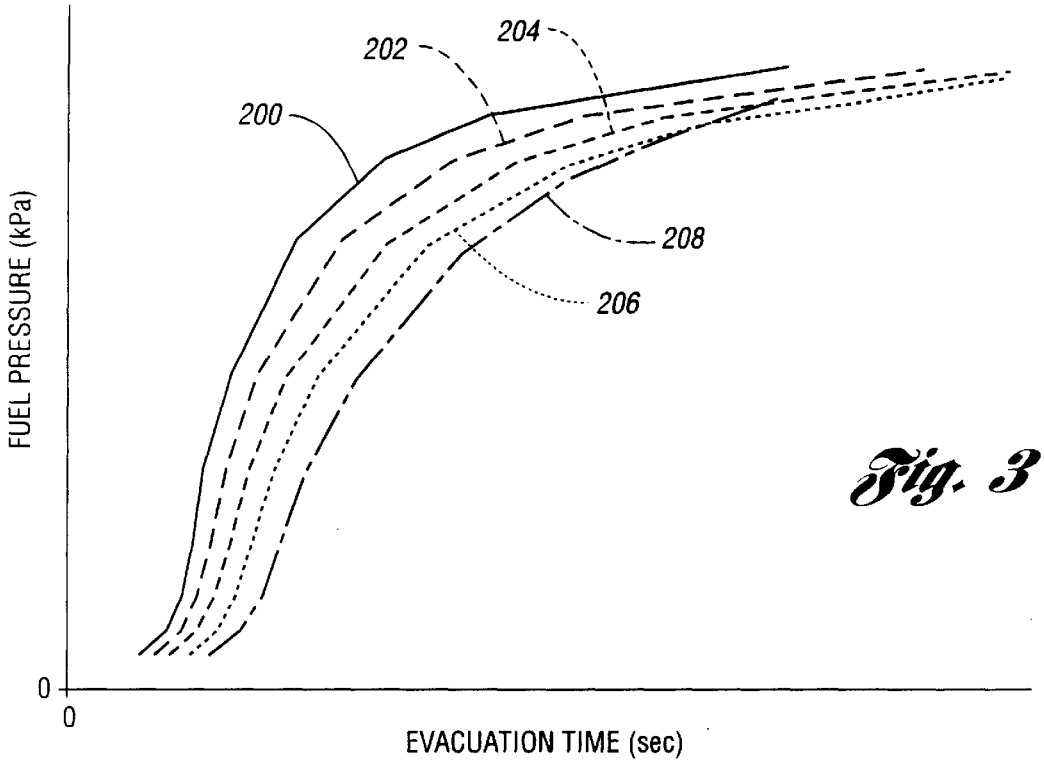
Fig. 3

Fig. 4
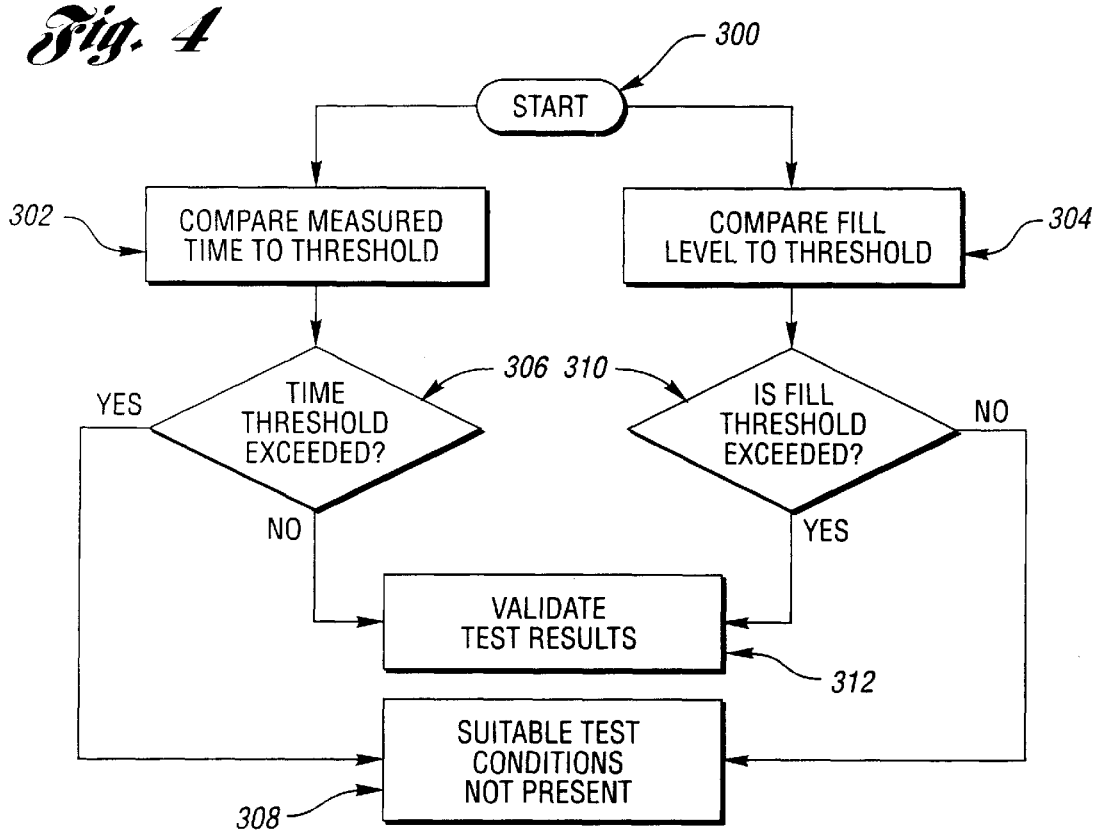
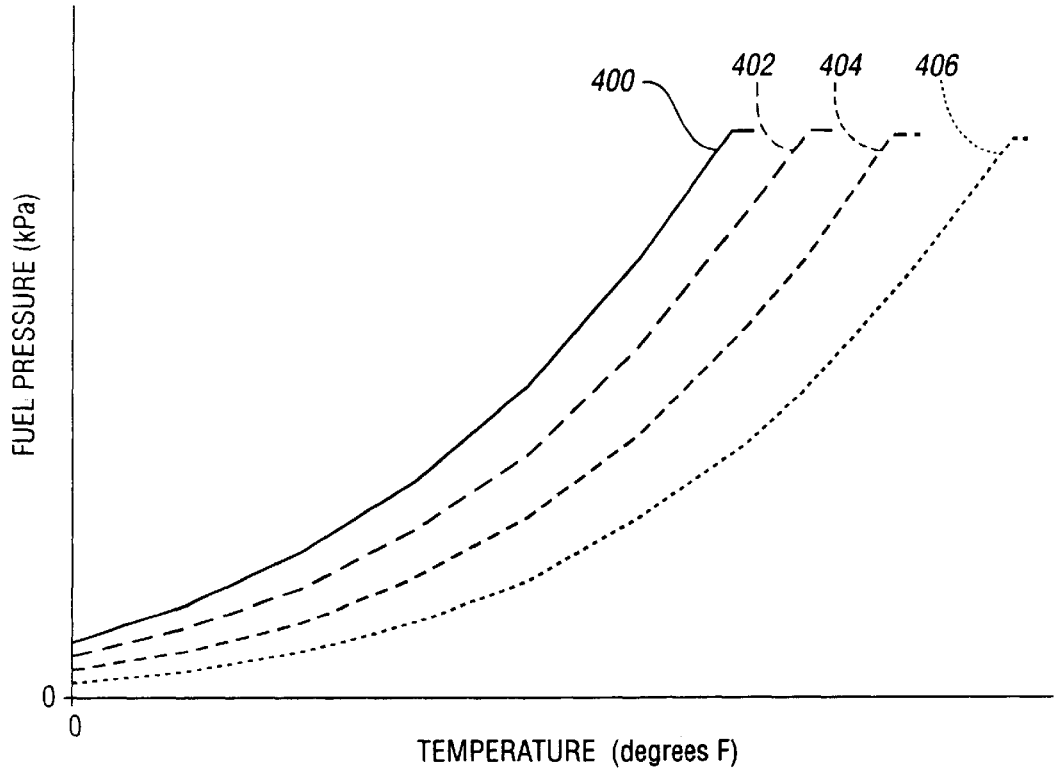
Fig. 5

METHOD AND SYSTEM FOR ESTIMATING FUEL VAPOR PRESSURE

TECHNICAL FIELD

The present invention relates to fuel vapor management systems used with internal combustion engines, and more particularly to an improved method and system for estimating or quantifying fuel vapor pressure.

BACKGROUND ART

Generally speaking, because automobiles emit volatile fuel vapors into the atmosphere, regulations were established requiring fuel vapor management systems to be included in all automobiles so as to prevent or otherwise reduce these emissions. Typical fuel vapor management systems include a carbon filled canister to absorb unburned fuel vapors, and a centrally managed vent and valve control arrangement for routing flow of the fuel vapors to either the carbon filled canister or to the engine intake for proper combustion therein.

In addition, regulations have also been established which require such fuel vapor management systems to include an on-board diagnostic capability for detecting the existence of leaks within the system. An example of one such diagnostic system is commonly owned U.S. Pat. No. 5,261,379 to Lipinski et al. In general, during testing operation, these systems apply a partial vacuum to the fuel tank of the vehicle until a predetermined pressure level is reached. Once the predetermined pressure level is reached, the tank is sealed, and the system measures the amount of vacuum "bleed off" or change in pressure over a predetermined period of time.

However, performance of typical diagnostic systems is a direct function of such factors as tank flex, fuel temperature, heat added by circulated fuel and ambient or underbody air temperature, fuel RVP (Reid Vapor Pressure), and age of the fuel. In addition, because of new regulations requiring diagnostic systems to be able to validly detect a leak equivalent to a 0.020 inch (0.051 cm) diameter hole, such factors have become even more problematic to producing reliable test results.

Detection of fuel vapor pressure is employed in some diagnostic and fuel vapor management systems as part of the overall process for detecting the presence of leaks. One way of attempting to quantify fuel vapor pressure is to measure fuel temperature, and then calculate fuel vapor by correlating the temperature measurement with a predefined table showing which fuel vapor pressure should be present for a particular fuel at a given temperature. The problem with such an arrangement is that there is no accommodation for the effects of fuel RVP and age, which materially alter the relationship between fuel vapor pressure and fuel temperature.

DISCLOSURE OF THE INVENTION

Therefore, it is an object of the present invention to overcome the limitations of known systems by providing a method and system which estimates actual fuel vapor pressure.

This and other objects are achieved by providing a method and system for estimating fuel vapor pressure which determines an amount of liquid fuel present in a fuel tank, applies a vacuum to the fuel tank, and measures a length of time necessary to reach a predetermined pressure within the fuel tank. The fuel vapor pressure is determined, i.e., quantified, based on the measured length of time and the detected amount of liquid fuel.

In further accordance with one aspect of the present invention, the measured length of time or estimated fuel vapor pressure can be used in combination with the known amount of liquid fuel as a method for validating results from a separate vapor leak test, such as the results of a conventional 0.040 in hole leak test under the new 0.020 in. hole regulatory standard, by providing an indication of whether acceptable conditions were present when the leak test was performed.

In further accordance with another aspect of the present invention, effective fuel volatility can be determined based on a detected temperature of the fuel and the determined fuel vapor pressure.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 2 is a flowchart showing a method of estimating fuel vapor pressure in accordance with the present invention;

FIG. 3 is a graph showing the relationship between vapor pressure and time for a plurality of different tank fill levels;

FIG. 4 is a flowchart showing a method of validating results from a vapor leak testing operation in accordance with the present invention; and FIG. 5 is a graph showing a plot of fuel vapor pressure vs. temperature for various effective fuel RVP values.

BEST MODE FOR CARRYING OUT THE INVENTION

Figure 1:
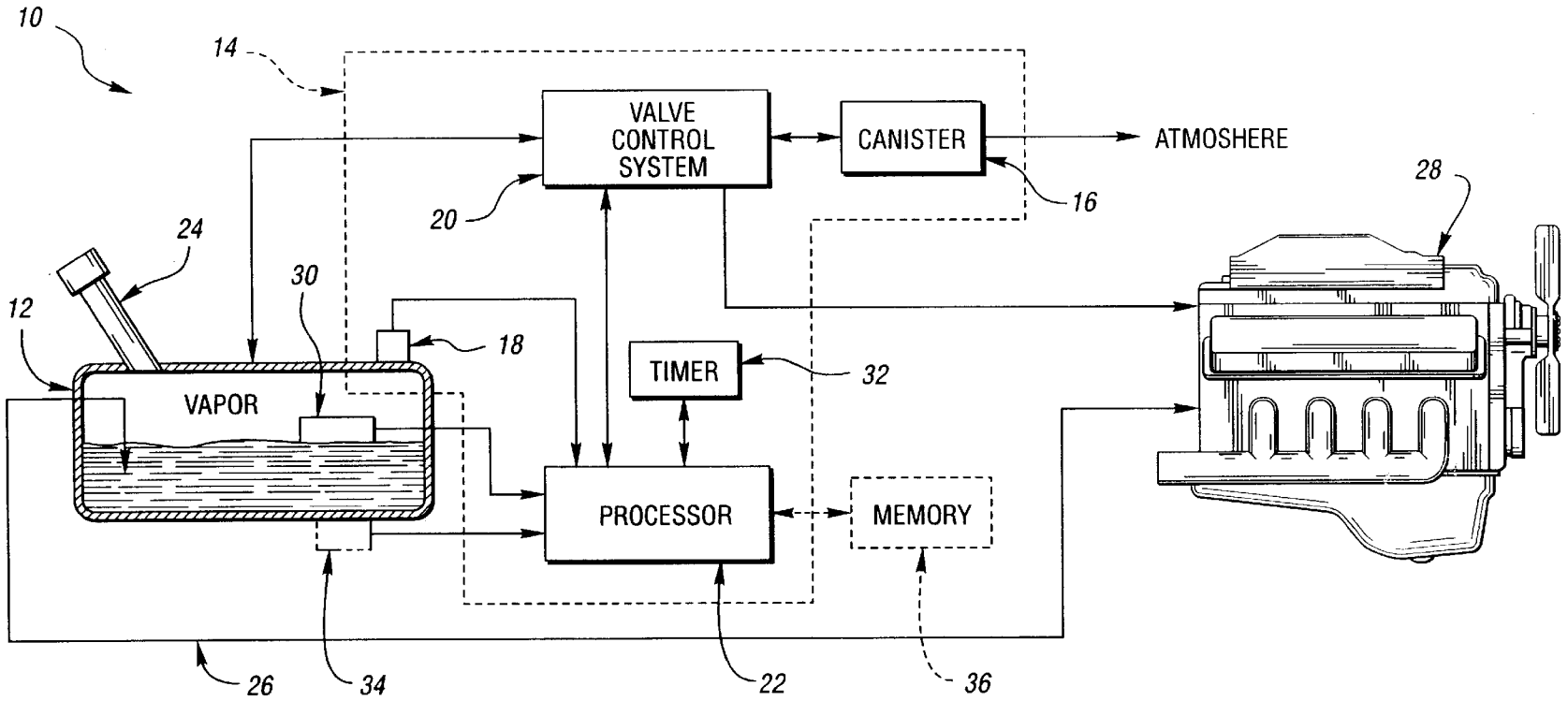
FIG. 1 is a block diagram showing a fuel vapor management system in accordance with the present invention.

Referring to FIG. 1, in accordance with a preferred embodiment, a system 10 for estimating fuel vapor pressure in a fuel tank 12 is formed from components already existing in a conventional automobile fuel vapor management system 14. More specifically, a conventional fuel vapor management system 14 includes a carbon filled canister 16 having controlled venting to atmosphere, tank pressure transducer 18, valve control system 20, and a control processor 22. Fuel vapor management system 14 operates in conjunction with a conventional fuel delivery system having a fuel tank filler pipe/cap 24, and fuel supply line 26 for delivering fuel to an internal combustion engine 28. Operation of each of these components is well understood by one having ordinary skill in the art, and only those features necessary for understanding operation of the method for estimating fuel vapor pressure in accordance with the present invention will be more fully described hereinbelow.

As shown in the flowchart of FIG. 2, the method for estimating fuel vapor pressure is initiated at start block 100 which proceeds to block 102 where the amount of fuel present in the tank, i.e., the "fill level," is determined. This information can be provided by a conventional sending unit 30. Then, a partial vacuum or negative pressure is applied to the fuel tank 12 at block 104 so as to pump out the air and fuel vapor mixture until a predetermined gauge pressure is reached. In the preferred embodiment, application of the partial vacuum to the fuel tank occurs normally during an evacuation phase of a vapor leak detection process typically integrated into vapor management system 14. As denoted at block 106, processor 22 continually obtains a tank pressure reading from pressure transducer 18 in order to determine when the predetermined pressure has been reached.

In accordance with the present invention, at block 108 processor 22 measures the amount of time necessary to reach the predetermined gauge pressure. As fuel vapor is pumped out of tank 12, the liquid fuel will correspondingly vaporize in an attempt to maintain liquid-vapor equilibrium, thereby effectively replacing the fuel vapor present in the tank as the vapor mixture exits the tank. Because of this almost instantaneous vaporization, the pressure change detected by pressure transducer 18 is attributable only to the air component of the vapor mixture.

As a result, the time needed to reach the predetermined gauge pressure is proportional to the amount of fuel vapor pressure actually present in the tank when correlated with the detected fill level, i.e, the higher the fuel vapor pressure, the longer it will take to reach the desired gauge pressure. For example, the time necessary for reaching the predetermined gauge pressure for a partial fuel vapor pressure of 50 kPa will be almost double the time necessary for a partial pressure of 0 Kpa. While the correlation between evacuation time and fuel vapor pressure is not exact because equilibrium can not be precisely maintained, the correlation is close enough to produce a suitable estimation of the fuel vapor pressure. Thus, the fuel vapor pressure is quantified at block 110 based on the measured time and the detected fill level, such as by way of a look-up table stored in a memory.

To illustrate the relationship between fuel vapor pressure and time given a particular tank fill level, FIG. 3 provides a graph showing vapor pressure vs. time for a plurality of fill levels, where line 200 represents a 90% fill level, line 202 represents a 70% fill level, line 204 represents a 50% fill level, line 206 represents a 30% fill level, and line 208 represents a 10% fill level.

The quantified estimate of the fuel vapor pressure can be advantageously used in many applications. One such application is in a leak detection system, where the results of the testing process are significantly impacted by the rate of heat transfer to the fuel in the tank. More specifically, heat transfer to the fuel causes a corresponding change to the equilibrium vapor pressure in the tank. This problem is accentuated by the fact that heat transfer to the fuel is highly variable and difficult to measure. Further, because even small changes in fuel vapor pressure are significant when compared to the change in evacuation pressure which a conventional leak detection system would deem indicative of a leak, such conventional leak detection systems can be easily fooled into generating inaccurate results. For example, a change of only 1% in fuel vapor pressure during a pressure monitoring phase of a leak test can prohibit the system from detecting a leak. This factor has become even more problematic due to regulations requiring leak detection systems to operate in accordance with more stringent leak detection standards.

However, because it was discovered that high fuel vapor pressures are indicative of rapidly changing fuel vapor pressure, a long period of time to reach the desired gauge pressure during an evacuation phase of a leak testing procedure denotes unfavorable test conditions. As a result, in accordance with the present invention, the time necessary to reach the predetermined gauge pressure can be compared to a predefined time value as a threshold indicator of whether conditions exist which would permit reliable results from a leak test.

More specifically, as shown in FIG. 4, a method for determining whether suitable leak testing conditions are present, particularly for validating conventional leak test results under the more stringent 0.02 inch leak standard noted above, begins at block 300 and proceeds to block 302 where the measured length of time to reach the predetermined pressure is compared to a calibratable time threshold value, and to block 304 where the fill level of the tank is compared to a calibratable fill threshold value. As shown at block 306, processor 22 determines whether the time threshold has been exceeded, and if it has, processor 22 determines at block 308 that suitable test conditions were not present during the leak test. On the other hand, if the time threshold is not exceeded, thereby indicating that the fuel vapor pressure is not too high, processor 22 validates the vapor leak test results at block 312.

In addition to block 306, processor 22 determines at block 310 whether the fill threshold has been exceeded. If this threshold is not exceeded, thereby indicating a low amount of liquid fuel being present, processor 22 determines at block 308 that suitable test conditions were not present during the leak test. Otherwise, validation of the leak test results is made at block 312.

While the method for validating leak test results has been described as comparing the measured length of time to a time threshold, an alternative embodiment could be provided which compares the estimated fuel vapor pressure to a calibratable vapor pressure threshold. In such an alternative arrangement, if the fuel vapor pressure exceeded the pressure threshold, i.e., indicating the pressure was too high, then processor 22 would determine that suitable conditions were not present during the leak test.

Another application of the present invention is to use the estimated fuel vapor pressure to further estimate instantaneous fuel volatility, which could be subsequently used to adjust or optimize transient fuel compensation during start-up and normal operation of the engine. More specifically, if a fuel management system could be provided with information indicative of instantaneous fuel volatility (RVP), appropriate adjustments could be made to fuel compensation to optimize vehicle driveability with regulatory emission requirements. Determination of fuel volatility has been problematic in the past because individual fuels can possess a different RVP. Thus, one would need to know an original RVP of each fuel being used. In addition, fuel RVP can change as the fuel ages. Thus, even knowing an original RVP of a fuel may not provide a reliable measure.

However, in accordance with the present invention, as long as fuel vapor leaks have not been detected, if temperature of the fuel is known, correlation with the estimated fuel vapor pressure will provide an estimate of the fuel's current volatility, irrespective of knowledge of the original RVP or change in RVP due to age of the fuel. This correlation is shown in the graph of FIG. 5, where line 400 represents a plot of fuel vapor pressure vs. temperature for an 11.2 RVP fuel, line 402 represents a plot of a 9 RVP fuel, line 404 represents a plot of a 6.8 RVP fuel, and line 406 represents a plot of a 4.6 RVP fuel. Fuel temperature information could be input to processor 22 via a sensor 34 connected to the tank as shown in FIG. 1. The estimated RVP could be stored in any type of memory 36, such as a RAM, EEPROM, or KAM (Keep Alive Memory), for access by the fuel management system.

While the best mode for carrying out the invention has been described in detail, those familiar with the art to which this invention relates will recognize various alternative designs and embodiments for practicing the invention as defined by the following claims.

What is claimed is:

1. A method for estimating fuel vapor pressure comprising the steps of:

determining an amount of liquid fuel present in a fuel tank;

applying a vacuum to the fuel tank;

measuring a length of time necessary to reach a predetermined pressure within the fuel tank; and determining fuel vapor pressure based on the measured length of time and the detected amount of liquid fuel.

2. The method of claim 1 further comprising the steps of detecting a temperature of the fuel, and estimating effective fuel volatility based on the detected temperature and the determined fuel vapor pressure.

3. The method of claim 1 further comprising the steps of comparing the measured length of time to a time threshold value, and validating results of a fuel vapor system leak testing procedure if the time threshold is not exceeded.

4. The method of claim 3 further comprising the steps of comparing the amount of fuel present in the fuel tank to a fill level threshold value, and validating the results of the vapor leak testing procedure if the fill level threshold value is exceeded.

5. The method of claim 1 further comprising the steps of comparing the estimated fuel vapor pressure to a vapor pressure threshold value, and validating results of a fuel vapor system leak testing procedure if the vapor pressure threshold is not exceeded.

6. The method of claim 5 further comprising the steps of comparing the amount of fuel present in the fuel tank to a fill level threshold value, and validating the results of the vapor leak testing procedure if the fill level threshold value is exceeded.

7. The method of claim 1 wherein said step of applying a vacuum is performed during an evacuation phase of an on-board fuel vapor leak testing process.

8. A system for estimating fuel vapor pressure comprises:

a first sensor connected to a fuel tank for providing an output indicative of an amount of liquid fuel present in the tank;

means for applying a vacuum to the fuel tank;

a second sensor connected to the tank for providing an output indicative of pressure within the tank;

a processor connected to said first and second sensor, said processor including means for comparing the output of said second sensor to a predetermined pressure value; and a timer connected to said processor for measuring a length of time necessary for the output of said second sensor to reach the predetermined pressure value, wherein said processor determines fuel vapor pressure based on the measured length of time and the amount of liquid fuel present in the tank.

9. The system of claim 8 further comprising a third sensor connected to the tank for providing an output indicative of liquid fuel temperature, wherein said processor is responsive to the output of said third sensor for estimating effective fuel volatility based on fuel temperature and the determined fuel vapor pressure.

10. The system of claim 8 further comprising means for comparing the measured length of time to a time threshold value, wherein said processor validates results of a fuel vapor system leak testing procedure if the time threshold is not exceeded.

11. The system of claim 10 further comprising means for comparing the amount of liquid fuel to a fill level threshold value, wherein said processor validates the results of the vapor leak testing procedure if the fill level threshold value is exceeded.

12. The system of claim 8 further comprising means for comparing the estimated fuel vapor pressure to a vapor pressure threshold value, wherein said processor validates results of a fuel vapor system leak testing procedure if the vapor pressure threshold is not exceeded.

13. The system of claim 12 further comprising means for comparing the amount of liquid fuel to a fill level threshold value, wherein said processor validates the results of the vapor leak testing procedure if the fill level threshold value is exceeded.

14. A method for validating test results of a vapor leak test procedure comprises the steps of:

determining an amount of liquid fuel present in a fuel tank;

applying a vacuum to the fuel tank;

measuring a length of time necessary to reach a predetermined pressure within the fuel tank;

comparing the measured length of time to a time threshold value; and validating the fuel vapor system leak testing procedure results if the time threshold value is not exceeded.

15. The method of claim 14 further comprising the steps of comparing the amount of fuel present in the fuel tank to a fill level threshold value, and validating the results of the vapor leak testing procedure if the fill level threshold value is exceeded.

16. The method of claim 14 wherein said step of applying a vacuum is performed during an evacuation phase of the fuel vapor leak testing process.

* * * * *